US007399130B2

(12) United States Patent
Hirte et al.

(10) Patent No.: US 7,399,130 B2
(45) Date of Patent: Jul. 15, 2008

(54) PRINTER WITH QUICK RELEASE PRINT HEAD AND PLATEN TO PROMOTE INSTALLATION AND REMOVAL OF SAME

(75) Inventors: Mark Hirte, Deerfield, IL (US); Edward Thomas, Round LakeBeach, IL (US); Jose Pioquinto, Round Lake, IL (US); Patrick Eiswerth, Lakemoor, IL (US); Ewa Blizniak, Mundelein, IL (US)

(73) Assignee: ZIH Corporation, Hamilton (BM)

( * ) Notice: Subject to any disclaimer, the term of this patent is extended or adjusted under 35 U.S.C. 154(b) by 148 days.

(21) Appl. No.: 11/063,930

(22) Filed: Feb. 23, 2005

(65) Prior Publication Data

US 2005/0276645 A1 Dec. 15, 2005

Related U.S. Application Data

(60) Provisional application No. 60/521,175, filed on Mar. 3, 2004.

(51) Int. Cl.
*B41J 25/34* (2006.01)

(52) U.S. Cl. ..... 400/120.16; 347/197

(58) Field of Classification Search ..... None
See application file for complete search history.

(56) References Cited

U.S. PATENT DOCUMENTS 5,085,533 A 2/1992 Kitahara et al.
5,366,302 A * 11/1994 Masumura et al. ..... 400/120.16
5,694,159 A 12/1997 Kajiya et al.
6,061,076 A * 5/2000 Ishii et al. ..... 347/197
6,283,651 B1 9/2001 Holmberg

FOREIGN PATENT DOCUMENTS

JP 03092374 A * 4/1991
JP 08156366 A * 6/1996
JP 2002-59597 A 2/2002

OTHER PUBLICATIONS

Machine translation of JP 08156366 to Suzuki from Japanese Patent Office website.*
Search Report for Chinese Patent Appl. No. 200510051877.4, completed Mar. 9, 2007.

* cited by examiner

*Primary Examiner*—Daniel J Colilla
(74) *Attorney, Agent, or Firm*—Alston & Bird LLP

(57) ABSTRACT

A printer for printing indicia upon media with print head and platen assemblies with ease of exchange and re-alignment features. The print head may be coupled to a print head bracket, the print head bracket removably coupled to the top cover of the printer by, for example, guide tabs of a print head support structure which mate with guide slots of the print head bracket. The print head bracket having alignment forks for aligning the print head with the platen. The printer also includes a platen bracket for maintaining the platen in the printer. The platen bracket being easy to remove to replace the platen.

16 Claims, 18 Drawing Sheets

PRINTER WITH QUICK RELEASE PRINT HEAD AND PLATEN TO PROMOTE INSTALLATION AND REMOVAL OF SAME

CROSS-REFERENCE TO RELATED APPLICATIONS

The present application claims priority from U.S. Provisional Patent Application No. 60/521,175 to Hirte et al., filed on Mar. 3, 2004, entitled: "Printer With Quick Release Print Head and Platen," the contents of which are hereby incorporated by reference.

BACKGROUND OF INVENTION

1. Field of the Invention

The invention relates to printers, and more specifically, the invention relates to a cost effective printer having a print head and/or platen with improved alignment and ease of installation and removal of same.

2. Description of Related Art

Printers have been adapted for extended operation via increased media capacity. With media exchange delayed by the increased media capacity, ease of exchange and re-alignment of printer wear components has increased significance with respect to reducing overall printer downtime and operating costs.

Thermal print heads are a wear component. The individual thermal elements and or the media contact surface of the print head that encloses the individual thermal elements degrade with use, eventually requiring removal and exchange of the print head.

For repeatable high quality printing, the print head is closely aligned with respect to the printer platen. However, each time the media is exchanged, the alignment between the print head and platen is disturbed to allow loading of the media between them.

Prior printers have incorporated relatively complex and therefore expensive to manufacture and service print head to platen alignment mechanisms with spring loaded cams, levers and or multiple guide surfaces. Other printers may be designed to trade ease of re-alignment and overall alignment precision for lowered manufacturing costs. In addition to the mechanical linkages, the print head is typically keyed to the platen shaft by a pair of fork arms that engage the platen shaft. While the fork arms are useful for alignment along the platen longitudinal axis, they typically provide only a limited side-to-side alignment function.

The platen is also a wear component. Further, the platen may also be fouled by media jams and or damaged by untrained operators attempting to clear media jams with sharp objects that gouge and or cut the relatively soft platen roller material. Because the platen is typically gear driven, mounted directly to the printer frame and buried under the print head alignment structures, removal of the platen for cleaning and or exchange may require printer disassembly beyond the capabilities of the typical user.

Competition in the printer industry has focused attention upon improving ease of use and print quality while reducing manufacturing materials and operations costs. Therefore, it is an object of the invention to provide a printer that overcomes deficiencies in such prior art.

SUMMARY OF THE INVENTION

The present invention provides apparatus, systems, and methods for facilitating insertion and removal of print heads and platens (or other media rollers) from a printer. For example, in one embodiment, the present invention provides a bracket for retaining a print head in a printer. The bracket comprises a body extending between opposed ends and front and rear surfaces and at least one alignment structure adjacent to the front surface of the body for aligning the print head with a platen in the printer. The bracket further includes at least on retaining structure adjacent to the rear surface of the body for retaining the bracket in the printer and at least one hole extending through the body for receiving a pivot pin located in the printer chassis, wherein hole allowing the bracket to pivot laterally and the retaining structure allows the bracket to move vertically with respect to a platen located in the printer. In some embodiments, the hole is a slot defined in the body and extends from the rear surface of the body toward the front surface of the body. The pivot pin may include a retaining lip that engages the hole in the bracket to secure it to the printer chassis.

In some embodiments, the alignment structure includes a contact surface configured to contact at least one of the platen or a bushing associated with the platen. The alignment structure may comprise a fork having tines extending from the body of the bracket for engaging the platen.

The retaining structure can take various forms. For example, the retaining structure may be a detent that mates with a spring structure in the printer or vice versa. The retaining structure may alternatively comprise at least one guide slot that engages at least one guide tab associated with the chassis of the printer.

The present invention also provides various bracket configurations for retaining the platen or similar media roller in a printer. For example, in one embodiment, the present invention provides a bracket comprising a contact surface for engaging at least one of the platen or a bushing associated with the platen and at least one connector for securing the contact surface to a printer. In some embodiments, the bracket may include a biasing structure for biasing the connector against the printer to thereby retaining the bracket against the platen.

In some embodiments, the bracket comprises a body having a width extending between opposed first and second ends and a height extending between opposed third and fourth ends. The bracket comprises a respective contact surface adjacent to each of the first and second ends of the body. One of the contact surfaces defines a curved surface that extends from the body and the other of the contact surfaces is a curve surface defined in the body.

The present invention also provides systems for maintaining and allowing for removal of a platen from a printer. In one embodiment, the system comprises a retaining structure located in the printer comprising a first contact surface for mating with at least one of the platen or a bushing associated with the platen. The first contact surface comprises an opening to allow insertion and removal of the platen from the contact surface. The system also includes a bracket comprising a second contact surface sized to mate with the opening in the first contact surface of said retaining structure, where the second contact surface engages at least one of the platen or a bushing associated with the platen. The bracket further includes at least one connector for securing the bracket to the printer, wherein the first and second contact surfaces retain the platen in the printer.

The present invention also provides a print head alignment arrangement for use in a printer. The arrangement includes a print head coupled to a print head bracket having a first alignment pin and a second alignment pin. A bracket is located in the printer having first and second alignment holes, wherein upon insertion of the first alignment pin and the second alignment pin into the first alignment hole and the second alignment hole, respectively, the print head is aligned with a platen of the printer.

BRIEF DESCRIPTION OF DRAWINGS

The accompanying drawings, which are incorporated in and constitute a part of this specification, illustrate embodiments of the invention and, together with a general description of the invention given above, and the detailed description of the embodiments given below, serve to ex-plain the principles of the invention.

DETAILED DESCRIPTION

Figure 1:
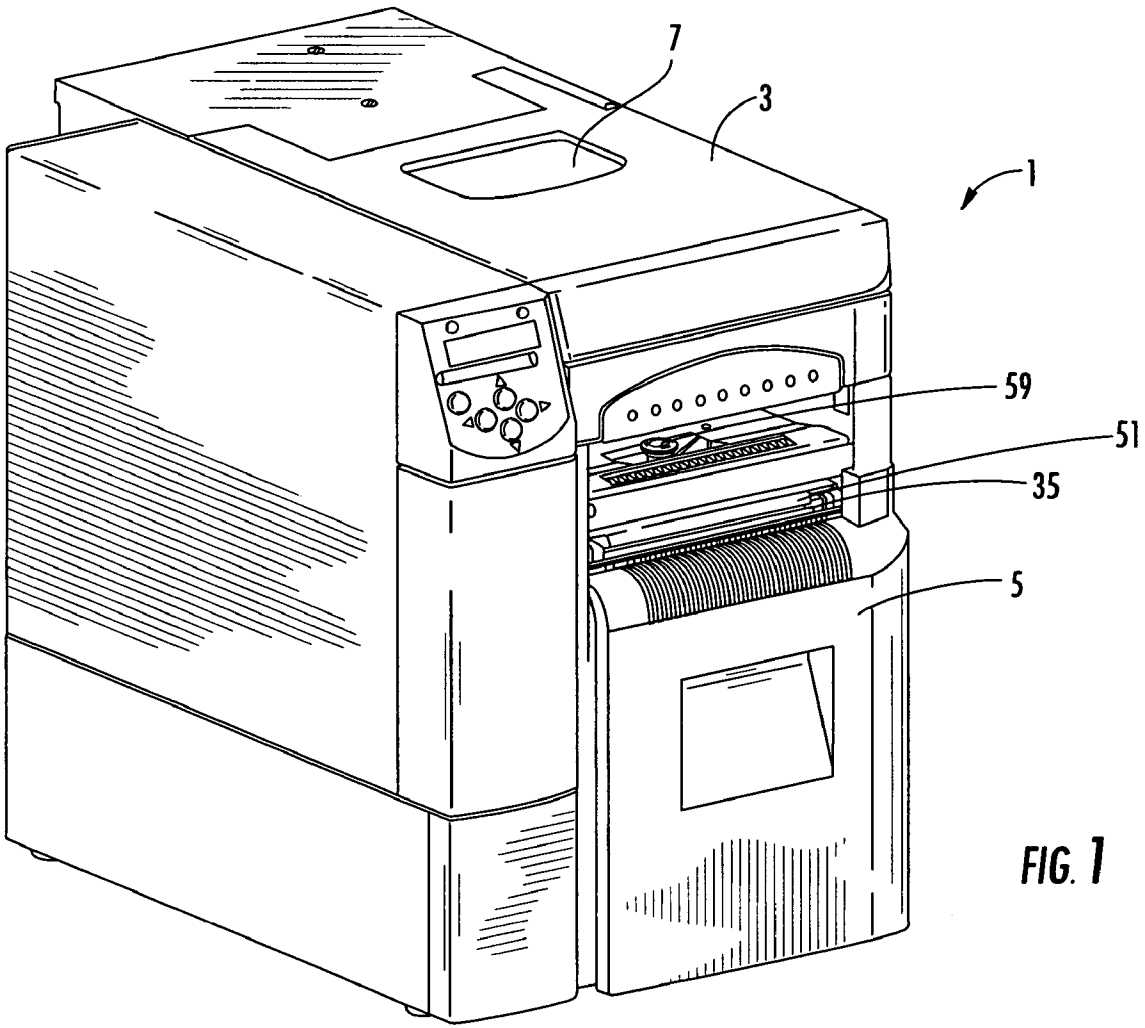
FIG. 1 is an isometric view of a printer, access doors closed, according to an exemplary embodiment of the invention.

An exemplary embodiment of the invention, in the form of a printer 1, including optional media liner rewind capability, is shown in FIG. 1. The printer 1 has two media access doors, a top door 3 and a front door 5. The top door 3 may include a media window 7 through which an operator may quickly visually verify the presence, type and remaining volume of loaded print ribbon and or media 9.

Figure 2:
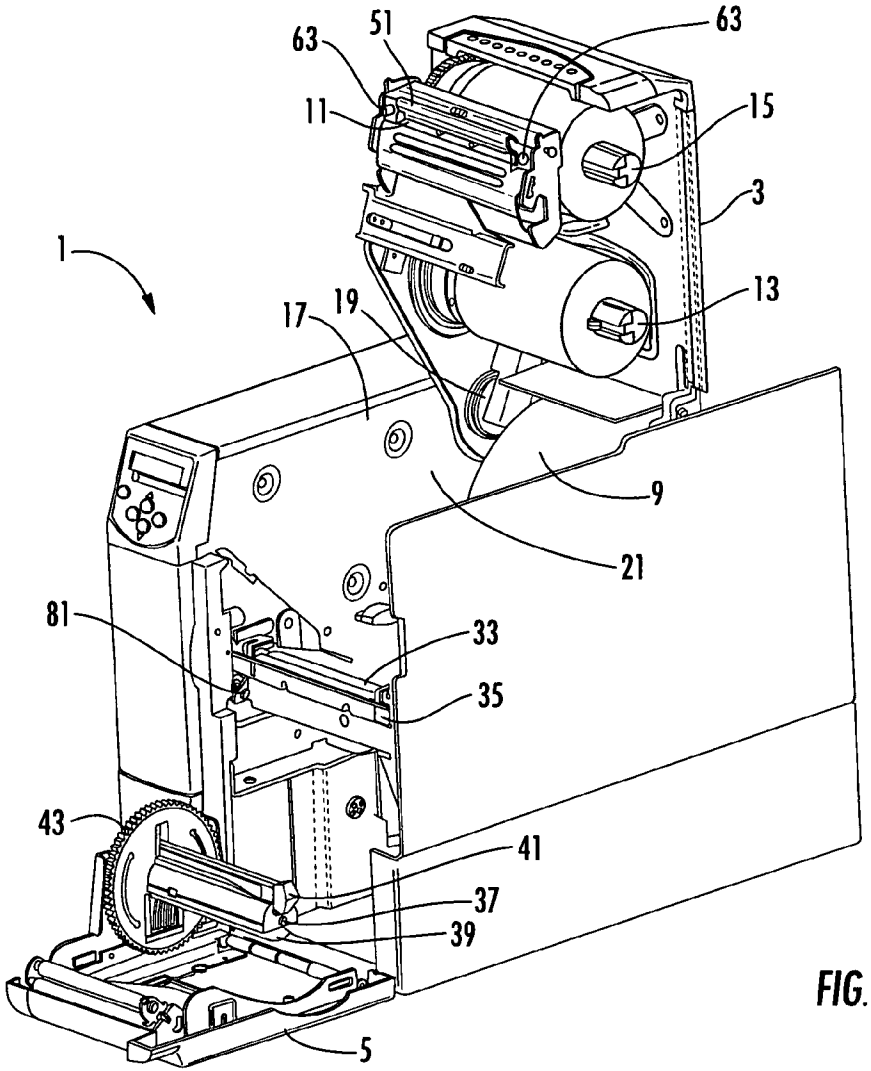
FIG. 2 is an isometric right side view of the printer of FIG. 1, access doors open.
Figure 3:
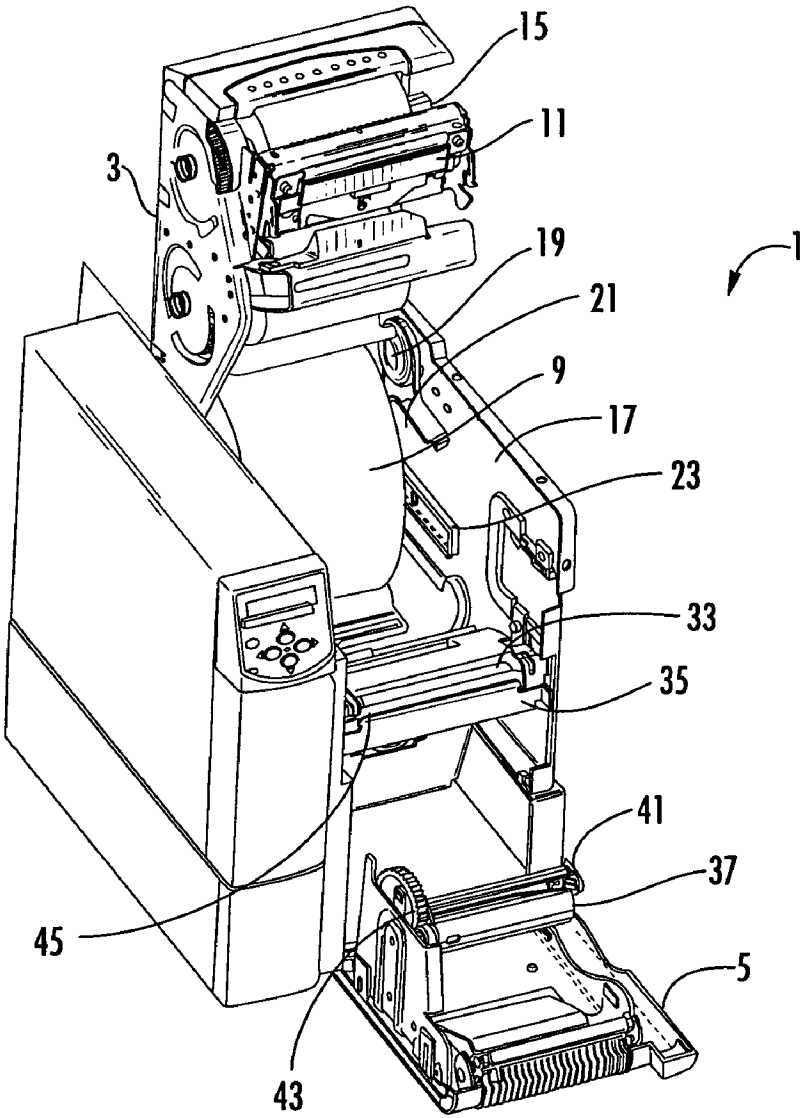
FIG. 3 is an isometric elevated left side view of the printer of FIG. 1, access doors open.

As shown in FIGS. 2 and 3, the top door 3 may be raised and the front door 5 lowered to access and or load the media 9. The print head 11, ribbon supply spindle 13 and ribbon take-up spindle 15 are attached to the top door 3. When the top door 3 is opened, the print head 11 and ribbon spindles are raised up and away from the media supply path, allowing front-loading access of the media 9. The media 9, in the form of, for example, labels on liner material is supplied in bulk rolls of a desired roll width. The top door 3 is pivotably coupled to the frame 17 of the printer 1 at pivot point(s) 19 on either side of a media cavity 21. The pivot point(s) 19 are selected to be at positions on either side of the media cavity 21 which allow the top door 3 to pivot open and allow insertion of the largest desired roll of media 9 usable with the printer 1. Additionally, the top door 3 may be configured to pivot upwards to a position short of extending behind the printer 1 so that space behind, in addition to directly adjacent the perimeter of the printer 1 need not be available to enable printer operation and or media exchange.

Figure 4:
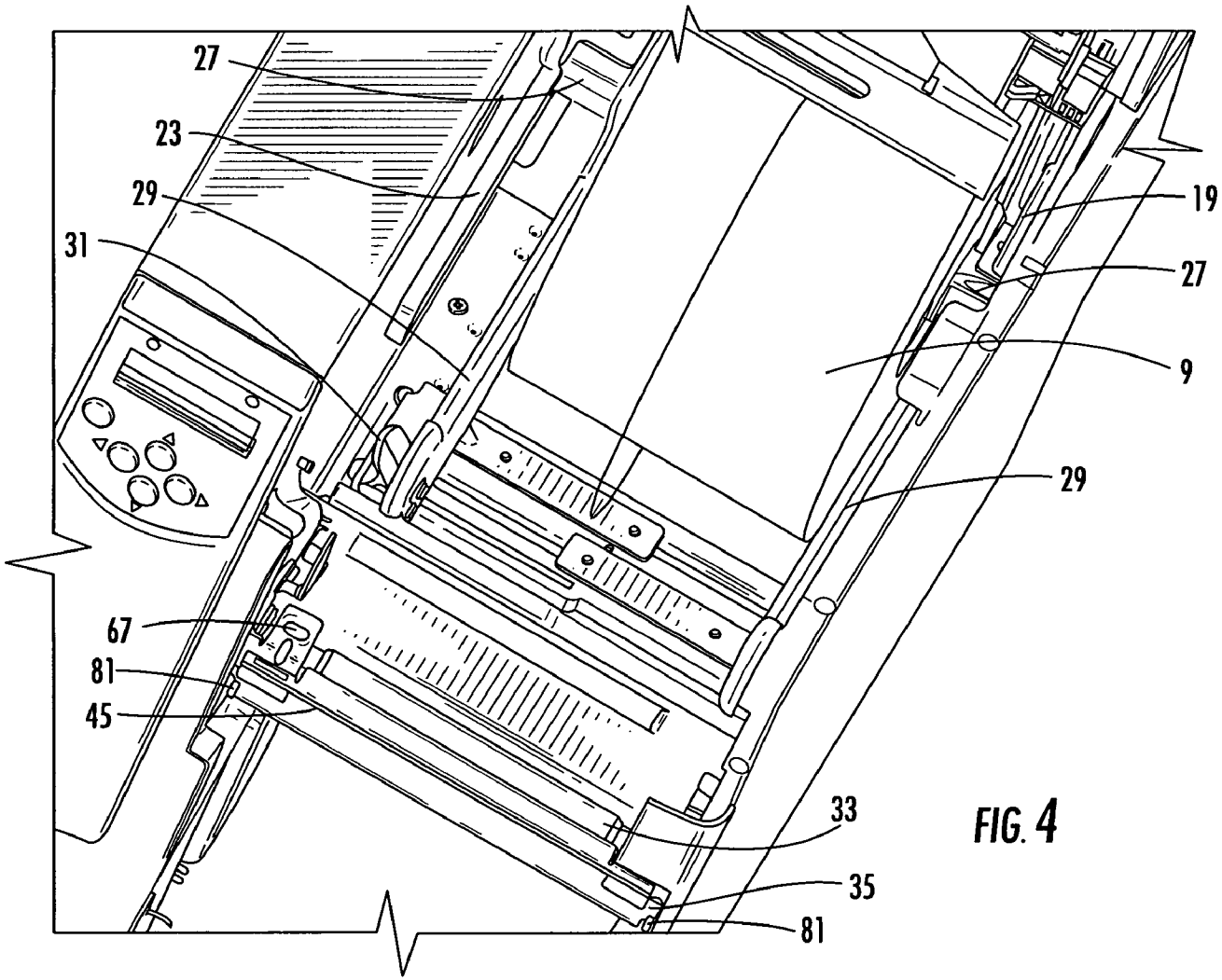
FIG. 4 is an elevated isometric view of the media loading area, media roll inserted, of the printer of FIG. 1.

To load media 9, as shown in FIG. 4, the operator pushes a media 9 roll carried by a media spindle 27 along guide rails 23 to the back of the media cavity 21 where the media spindle drops into depression(s) 25 formed in the guide rails 23. The media 9 may be centered between movable centering guides 29 which can be fixed in place via a spring lever 31. The operator then lays a leader portion of the media 9 from the media 9 roll across the platen 33 and closes the top cover 3, thereby sandwiching the media 9 between the print head 11 and the platen 33, ready for print operations.

Returning to FIGS. 2 and 3, in instances where the media includes labels located on a liner, the printer includes a liner take-up reel 37 that may be mounted to the front door 5 to facilitate printer 1 front end access to the liner roll which accumulates upon the take-up reel 37 during on-demand operation, de-scribed herein below. If on-demand operation is not desired, the front door 5 and associated liner collection structure may be omitted. The liner take-up reel 37 incorporates a clip 39 adapted to receive and grasp an initial end portion of the liner. To allow the clip 39 to grasp a liner from media 9 of varying widths, the clip 39 extends the length of the take-up reel 37 and is biased towards a center of the take-up reel 37. A ramp lever 41 is adapted for movement along a longitudinal axis of the take-up reel 37. During movement away from the take-up reel 37, the ramp lever 41 interacts with a ramp surface within the take-up reel 37 to also move radially inward with respect to the take-up reel 37, thereby decreasing the effective diameter of the take-up reel 37 and allowing easy removal of the accumulated liner roll. A spring or the like is used to bias the ramp lever 41 into a steady state position of maximum take-up reel 37 diameter. During operation, the take-up real is driven via the gear 43.

Figure 5:
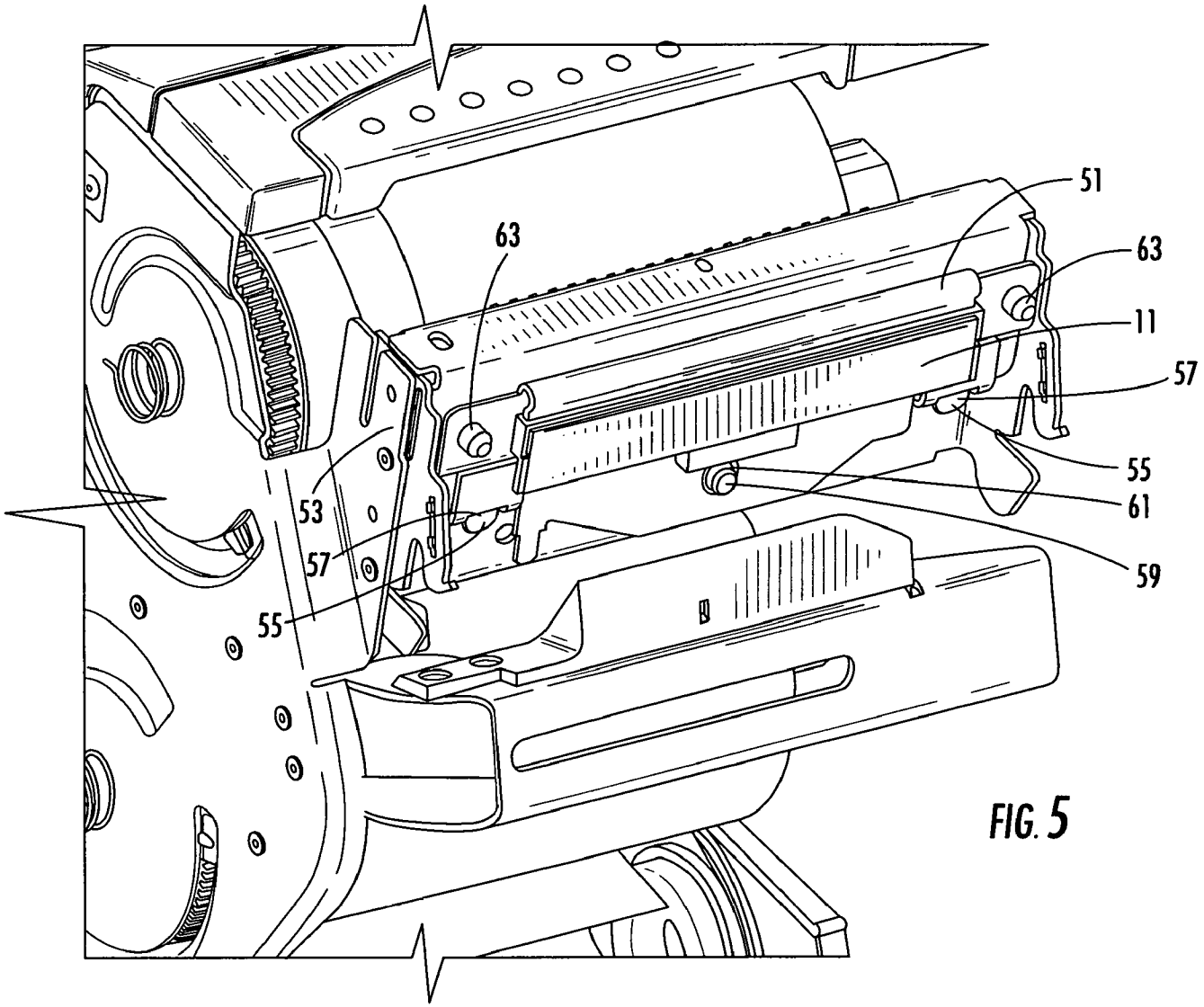
FIG. 5 is an isometric bottom view of a print head, mounted upon the printer of FIG. 1 according to one embodiment.
Figure 6:
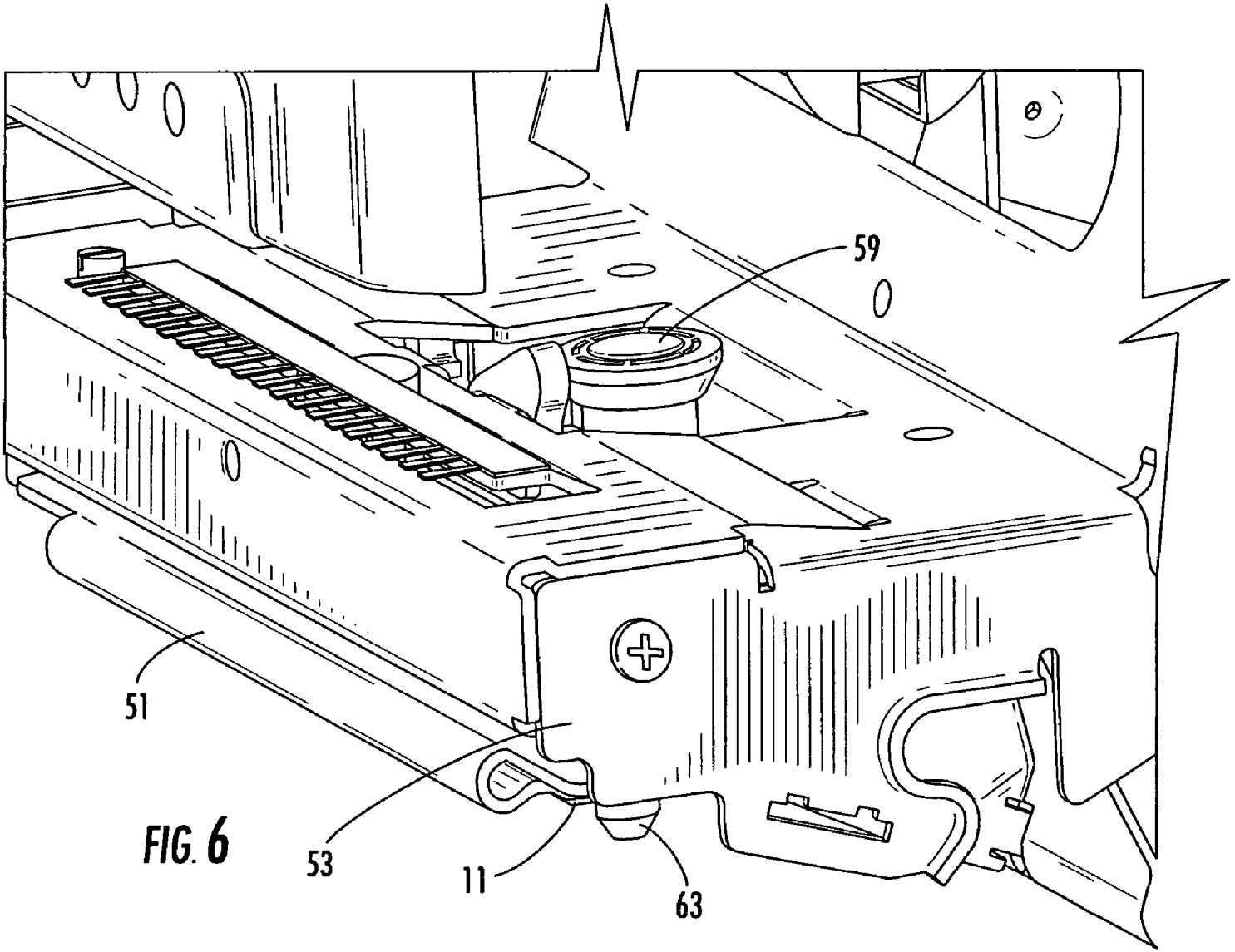
FIG. 6 is an isometric top view of the print head carrier assembly of the printer of FIG. 1 according to one embodiment.

In this embodiment, the platen quick release bracket 35 operates as a tear bar having a tear edge 45 against which the user may tear off each printed label with the liner attached for later removal immediately prior to label application. Depending upon whether printer output in the form of a printed label with or without a liner attached is desired, the printer may alternatively be fitted with the tear bar or a peel bar 47 as shown in FIGS. 5 and 6. Instead of the tear edge 45, the peel bar has a curved peel surface 49 which, as the liner is pulled across it, causes the forward edge of each label to separate from the liner, presenting a printed label to the user ready for immediate application.

In addition to providing structure that allows for ease in front loading of media and ribbon, the present invention also provides various systems and methods that allow for easy install and replacement of the print head and platen. Specifically, the present invention allows for easy replacement of the print head and platen in the field. This is important, where the life of the printer exceeds the useful life of the print head and platen, which require that such replacement be periodically made. Important considerations for infield replacement procedures are first that the procedure must be simple such that it can be performed with little or no training and second that replacement be time efficient, such that there is not significant down time for the printer.

In this regard, the present invention provides several different print head and platen configurations that allow for easy and quick replacement. For example, FIGS. 5-9 illustrate a first quick release print head bracket and platen bracket design according to one embodiment of the present invention.

As shown in FIGS. 5 and 6, the print head 11, supplied pre-mounted upon a print head bracket 51, mates with a print head carrier structure 53 attached to the top door 3 of the printer. The print head bracket 51 to print head carrier structure 53 interconnection is adapted to permit quick print head 11 exchange without requiring the use of tools.

Specifically, retaining structures, such as a pair of guide tab(s) 55, formed in the print head carrier structure 53 are adapted to mate with corresponding guide slots 57 formed in a forward edge of the print head bracket 51. As the print head bracket 51 is inserted so that the guide tab(s) 55 mate with the guide slot(s) 57, the print head 11 is loosely retained along a longitudinal axis of the guide slot(s) 57. To retain the print head bracket 51 at a desired position upon the guide tab(s) 55, a spring loaded pivot pin 59, (see FIG. 6), mates with a corresponding pin hole or slot 61, (see FIG. 5), formed in the print head bracket 51. An electrical connector (not shown) is used to make the electrical interconnection between the print head 11 and the printer 1. A loose lead cable allows the interconnection to be made before the print head bracket 51 is attached to the print head carrier structure 53.

When mounted upon the print head carrier structure 53, the print head bracket 51 is loosely retained, able to move and or pivot within a limited range defined by the fit of the pivot pin 59 within the pin hole/slot 61 and of the guide tab(s) 55 within the guide slot(s) 57. To accommodate alignment variances that may be introduced by the large movement arm associated with the rear location of the pivot point(s) 19 relative the platen 33, the loosely retained print head 11 is adapted for final self alignment upon closure of the print head 11 with the platen 33 as the top cover 3 is closed.

Figure 7:
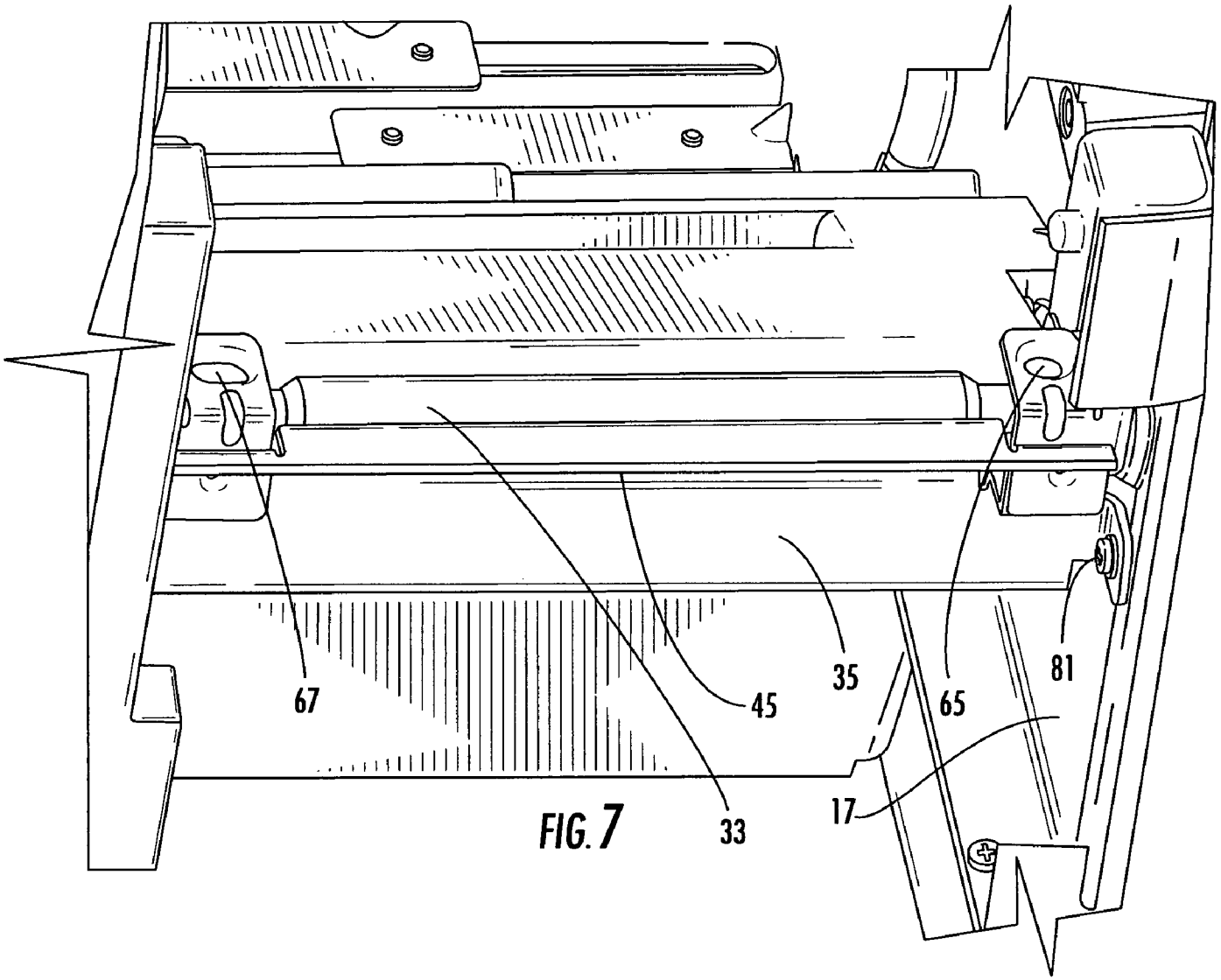
FIG. 7 is an elevated front isometric view of the platen and platen bracket, media omitted, of the printer of FIG. 1 according to one embodiment.

Specifically, to align the print head with platen, the print head of this embodiment further includes a pair of alignment pin(s) 63 projecting from the print head bracket 51. These alignment pins mate with corresponding first and second alignment hole(s) 65,67 formed in the base of the printer, such as in the platen bracket 35, as shown in FIG. 7. The peel bar 47, described herein below, may also be used in place of the tear bar. Conical tapering of the distal ends of the alignment pin(s) 63 and or edges of the first and second alignment hole(s) 65,67 guides the print-head 11 into alignment with the platen 33 as the alignment pins initially engage the first and second alignment hole(s) 65,67. To adapt for dissimilar thermal expansion coefficients and or lower the required component manufacturing tolerances, the second alignment hole 67 may be formed as an elongated slot. In this embodiment, the first alignment hole 65 sets the forward to back and left to right print head 11 alignment and the second alignment hole 67, with reference to the first alignment hole 65, sets the alignment of the print head 11 with respect to the longitudinal axis of the platen 33.

Figure 8:
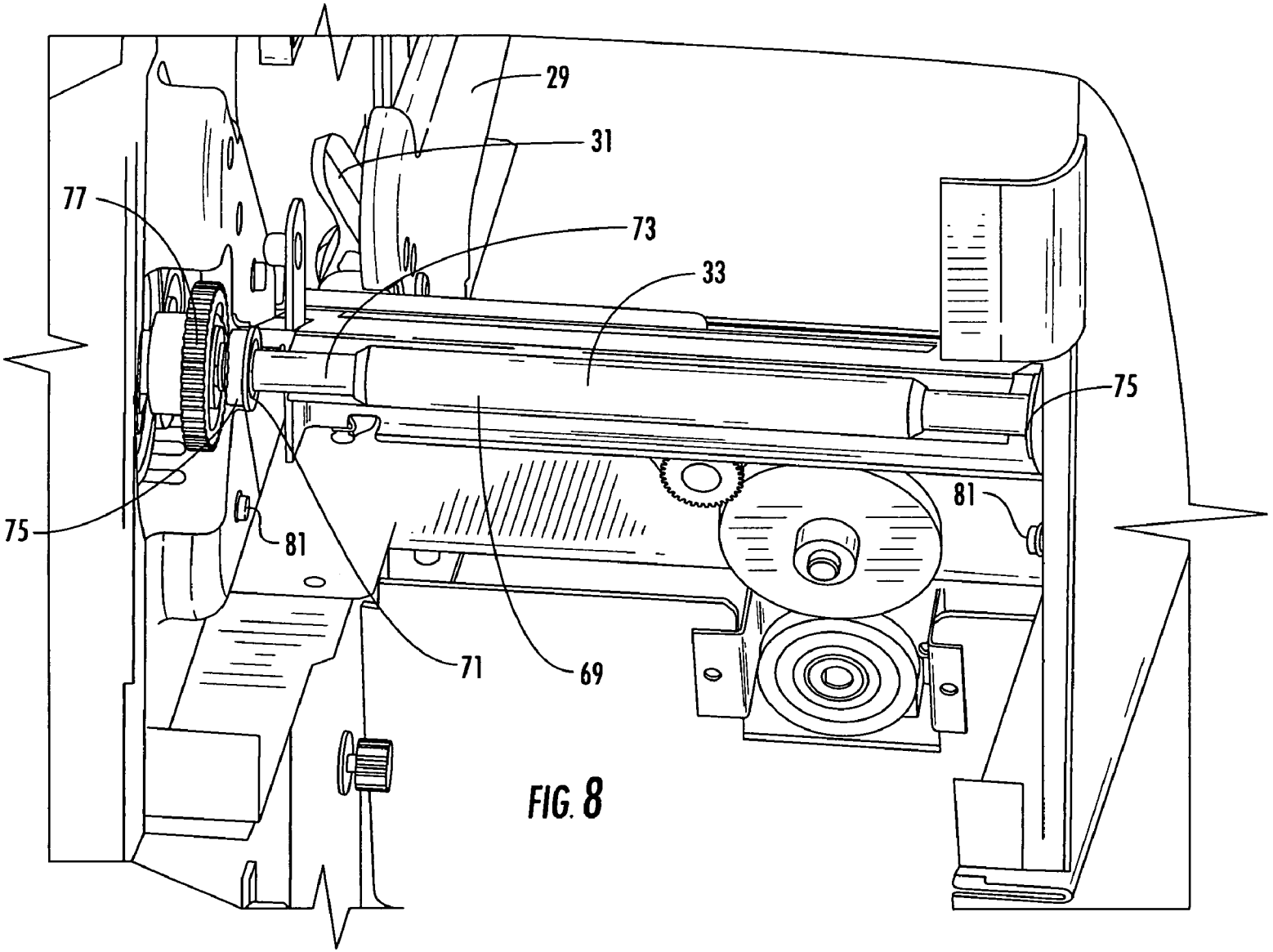
FIG. 8 is an elevated front isometric view of the platen and platen bracket, media omitted and platen bracket removed, of the printer of FIG. 1 according to one embodiment.

As shown in FIG. 8, the platen assembly 69 is aligned with respect to the printer frame 17 via platen mounting surface(s) 71 that receive and support bearings, sleeves or other form of rotatable mounting surface(s) 75 located on the platen shaft 73 at either end of the platen. The rotatable mounting surfaces may be the platen itself or bushings on the platen. The platen 33 may be driven by, for example, a platen gear 77 located at one end of the platen shaft 73 that engages a driving gear (hidden from view) as the rotatable mounting surface(s) 75 seat against the platen mounting surface(s) 71.

Figure 9:
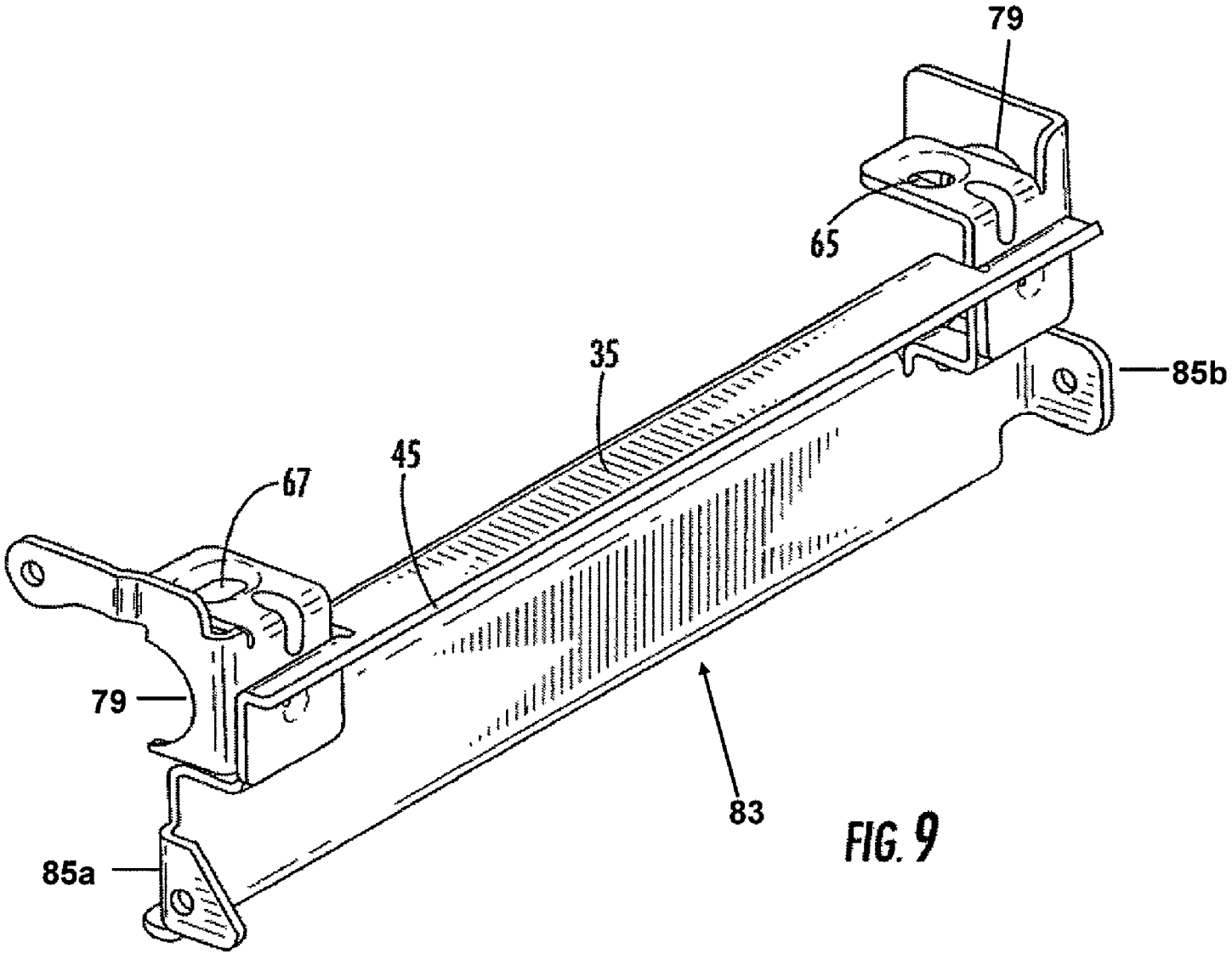
FIG. 9 is an isometric view of a platen bracket in the form of a tear bar according to one embodiment of the invention.

FIG. 9 illustrates one embodiment of a platen quick release bracket according to one embodiment of the present invention. The platen quick release bracket 35 is in the form of a tear bar in this embodiment. The bracket includes a body 83 extending between opposed ends 85*a* and 85*b*. The body has a surface that extends substantially parallel to a laterally extending axis of the platen. The body includes one or more contact surfaces 79 adjacent to the opposed end of the body. (See also FIG. 16). These contact surfaces 79 are structured to mate with either the platen itself or the rotatable mounting surface(s) 75 or other form of mounting surfaces associated with the platen. The bracket retains the rotatable mounting surfaces 75 via platen contact surface(s) 79*b* adapted to mate with a forward edge of the rotatable mounting surface(s) 75. (See also FIG. 16).

An aspect of the platen bracket is the ease with which it can be removed so as to allow access to the platen for repair or replacement. In this regard, the platen bracket includes one or more connectors, such as tabs 87, for connection to the printer chassis. There are various structures and methods from securing the bracket. For example, as shown in FIGS. 7 and 9, the tabs may include holes extending through the tabs. The tabs may be connected to either pins, not shown, located in the printer chassis, or receive fasteners, such as for example, frame mounting screw(s) 81 that screw into the frame 17. By removing the frame mounting screw(s) 81, the platen bracket 35 may be easily removed and the platen assembly 69 released in a forward direction for cleaning and or exchange without further disassembly of the printer 1.

Figure 11:
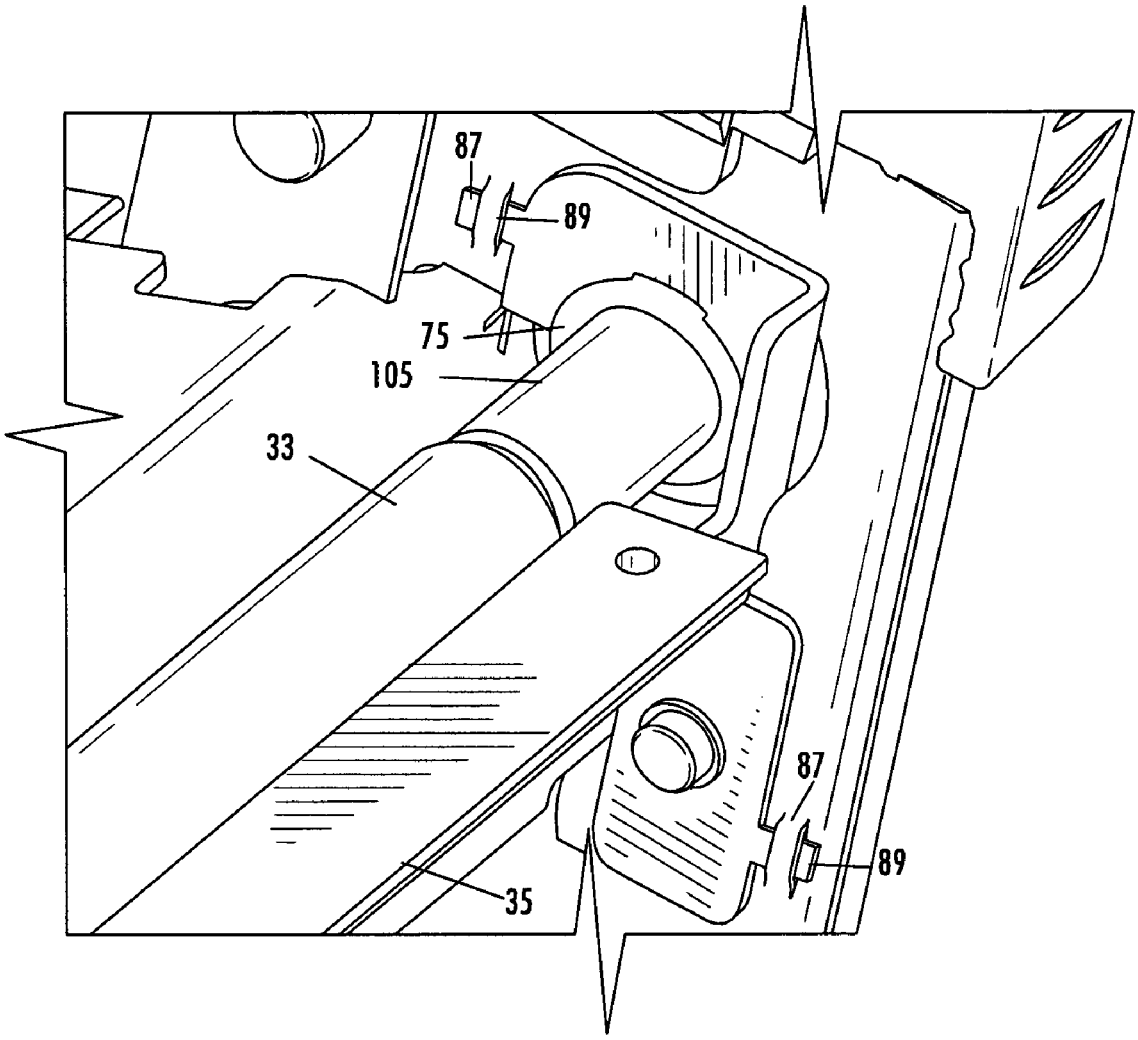
FIG. 11 is an isometric view of the platen bracket of one embodiment inserted into slots located in the chassis of the printer.

In other embodiments, the bracket can be attached with either a minimum or no fasteners. For example, as illustrated in FIG. 11, the printer chassis may include slots 89 for receiving the tabs 87. The bracket may include a biasing means, such as a spring, not shown, that biases the tabs with the slots. Alternatively, the bracket may sized slightly larger that the spacing of the slots and have a flexible structure that can be flexed to insert the bracket in the slot, whereby the body acts as a biasing structure.

While not illustrated, other embodiments of the bracket are envisioned. For example, the bracket could include hinge along its top edge for pivot connection to the printer chassis. This could be in the form of connector tab connected to the printer by a fastener. The bracket of this embodiment, includes a tab located at a bottom edge for fastening to the printer. Further, although the embodiments illustrated envision a bracket having a body that extends along the length of the platen, in some embodiments, the brackets could comprise one or clips located at either one or both ends of the platen for contacting and securing the platen in place.

Figure 10:
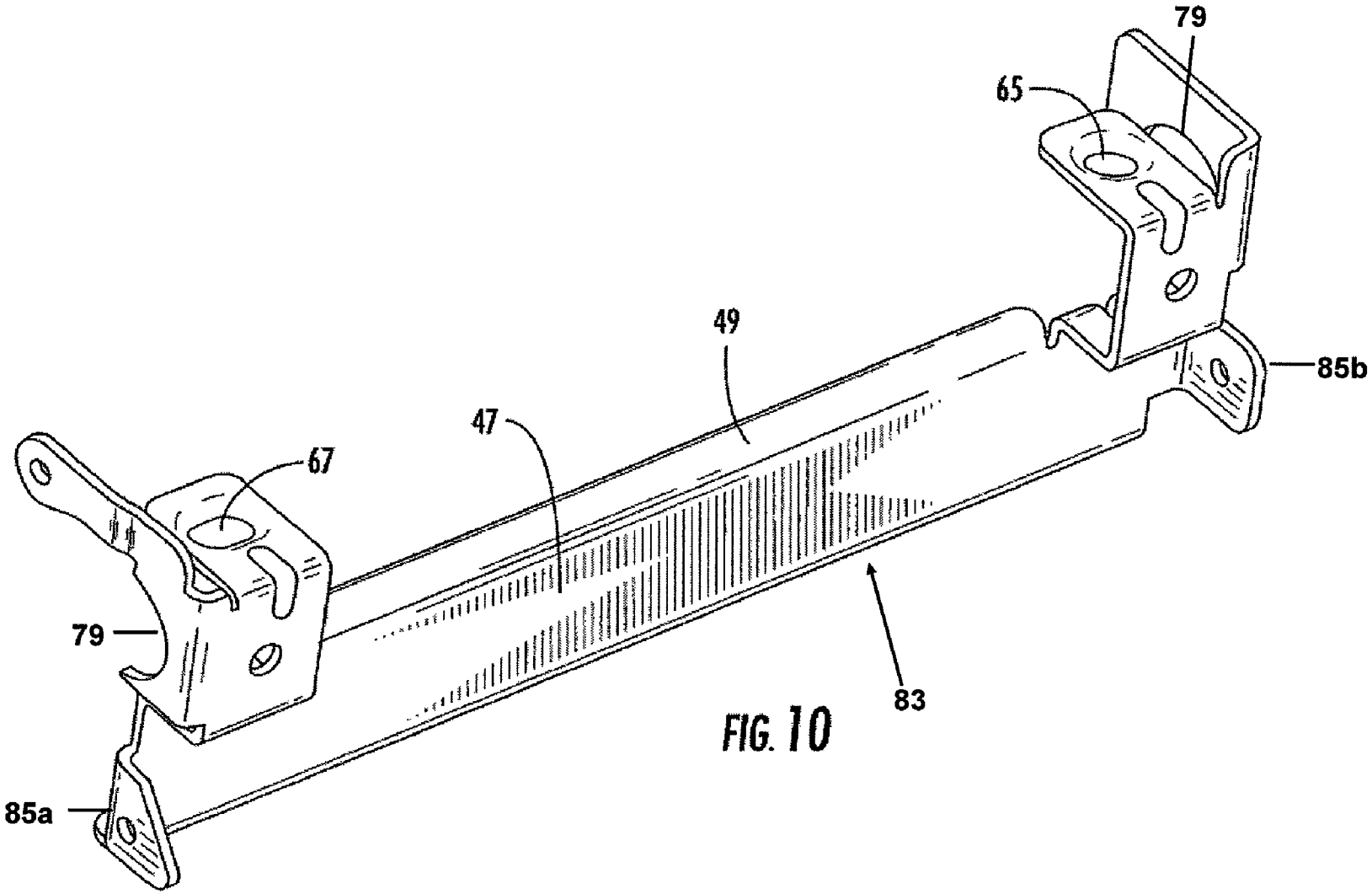
FIG. 10 is an isometric view of a platen bracket in the form of a peel bar according to one embodiment of the invention.

For on-demand operation, the platen bracket is in the form of a peel bar 47, as shown in FIG. 10, instead of a tear bar 35 and thereby the continuous liner, separated from each label by passage across the peel surface 49, may be routed to the liner take-up reel 37 for accumulation and eventual removal during media exchanges. Otherwise, the platen bracket has the same print head 11 and platen assembly alignment and retention characteristics as the platen bracket in the for of a tear bar. When required, the print head 11 may be quickly exchanged by hand. The self-aligning print head 11 configuration reduces the overall printer complexity, removes potential failure points and reduces overall manufacturing cost. The simplified media path of a printer according to the invention reduces the opportunities for media jams. Should a media jam occur, ready access without pinch points upon opening of the top cover 3 and front cover 5, if present, allows for quick recovery, reducing the chances that an operator attempting to clear the media path will damage the printer. The printer is adapted for removal of the platen assembly 69, when required, by unskilled personnel using simple hand tools. The capability to easily remove the platen assembly from the front of the printer further reduces the overall downtime of the printer.

As mentioned, the configuration of the print head bracket and platen bracket discussed above allows for ease in removal and replacement. For example with regard to FIG. 5, to remove the print head, a user depresses the pivot pin 59, such that the end of the pin clears the pivot pin hole 61 of the print head bracket. The user then pulls forward on the bracket so as to disengage the guide tabs 55 from the guide slots 57. In the illustrated embodiment, the pin hole represents a hole in the bracket. In some embodiments, the pin hole may be a slot extending from a back end of the bracket. In this embodiment, the pivot pin 59 may include a retaining lip, such that when the pin is slid along the slot, the retaining lip engages and holds the bracket. (See FIG. 13).

The platen can also be removed with similar ease. With reference to FIG. 7, the user can remove any fasteners retaining the platen bracket 35 and remove the bracket allowing access to the platen 33.

Figure 12:
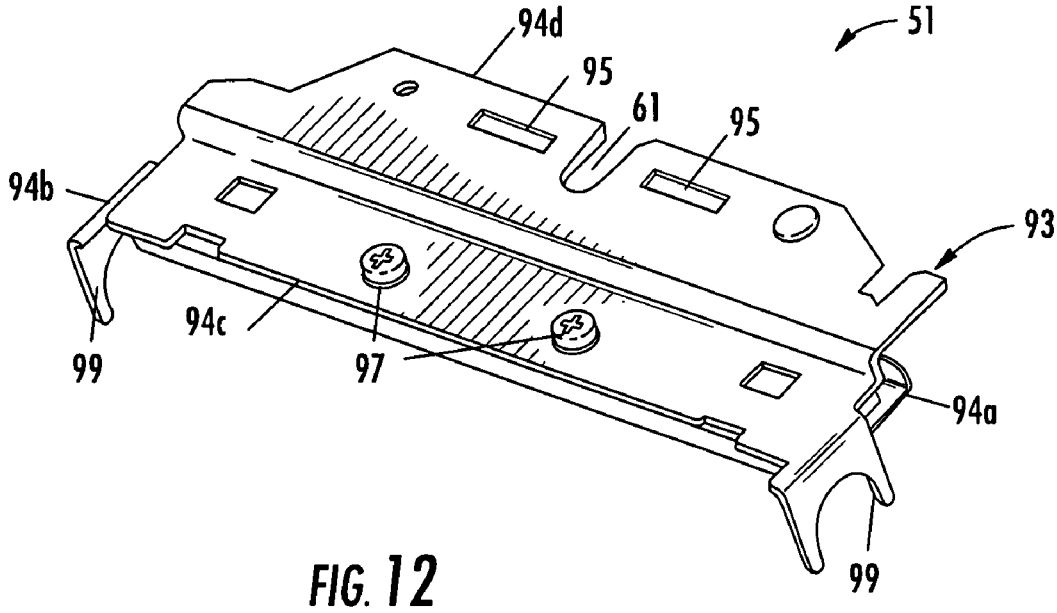
FIG. 12 is an elevated isometric view of the print head bracket according to an alternative embodiment of the present invention.

FIGS. 12-15 illustrate an alternative embodiment for the print head bracket 51. As illustrated in FIG. 12, the bracket of this embodiment includes a body 93 extending laterally between opposed first and second ends 94*a* and 94*b*, and front 94*c* and rear 94*d* surfaces. Located near the rear surface 94*d* of the bracket 51 is a pivot pin hole 61. The pivot pin hole 61 may be a hole through the plate. However, in some embodiments, the pin hole 61 defines a slot extending from the rear surface 94*d* to the front surface 94*c* of the bracket 51. The pivot pin hole could also be a detent. Located adjacent the rear surface 94*d* of the bracket 51 is one or more bracket retaining structure(s) 95. In the illustrated embodiment, the retaining structure is one or more detents. (The function of the retaining structure(s) is discussed later below.). The print head bracket 51 further includes one or more fasteners 97 for receiving and maintaining the print head, not shown, in the bracket. In addition, the print head bracket 51 also includes one or more alignment forks 99. As will be discussed later, the aligning forks 99 engage the platen during operation to thereby align the print head with the platen.

Figure 13:
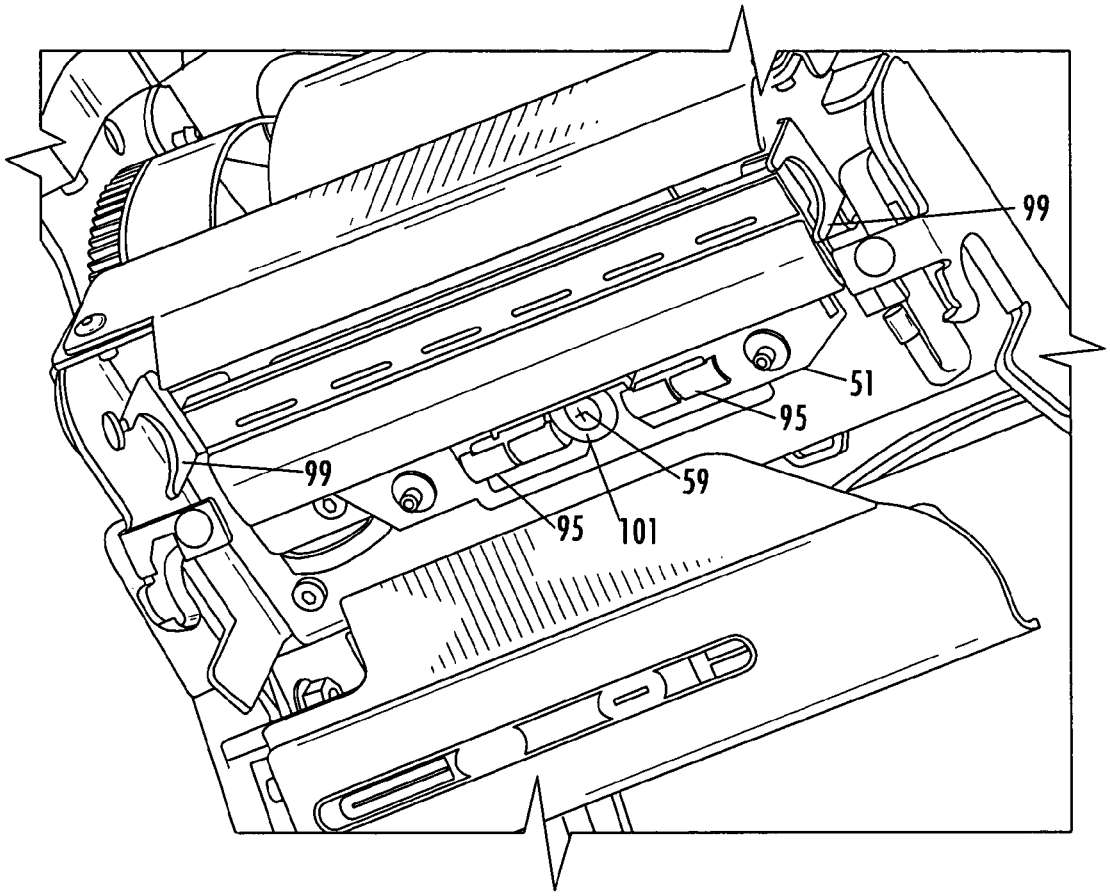
FIG. 13 is an isometric bottom view of a print head, mounted upon the printer of FIG. 1 using the print head bracket of FIG. 12.

FIG. 13 illustrates the installation of the print head bracket 51 in the printer 1. The printer chassis includes a pivot pin 59. The pin includes a body extending between opposed ends. A first or proximal end is connected to the printer chassis, while a second or distal end extends from the printer chassis for receiving the pin hole or slot 61, see FIG. 12, of the print head bracket 51. The pin may include a lip portion 101 located adjacent to the second or distal end of the pin. In this embodiment, the body of the pivot pin 59 is sized so as to fit within pin hole or slot 61, while the lip portion 101 is sized somewhat larger than the pin hole or slot 61 to thereby retain the print head bracket to the chassis.

To assist in retaining the print head bracket, the printer chassis may further include retaining structure(s) to engage the retaining structure(s) 95. For example, in one embodiment, either the retaining structure(s) of the printer chassis or the retaining structure(s) 95 of the bracket are spring structures and the other of the retaining structures. For example, in FIG. 12, the print head bracket 51 includes retaining structures in the form of detents 95. These detents mate with spring structures located in the printer to thereby aid in retaining the print head bracket in the printer. While detents and corresponding spring structures are illustrated, it is understood that any number of different retaining structure configurations can be implemented. The retaining structures loosely maintain the bracket in the printer chassis and may allow the bracket to pivot vertically.

It is also noted here that in the above embodiments, the term printer chassis is used in a general manner when referring to connection of the print head bracket and platen bracket to the printer. The brackets may be connected directly to the chassis or to brackets, covers, etc. located in or attached to the chassis.

Figure 14:
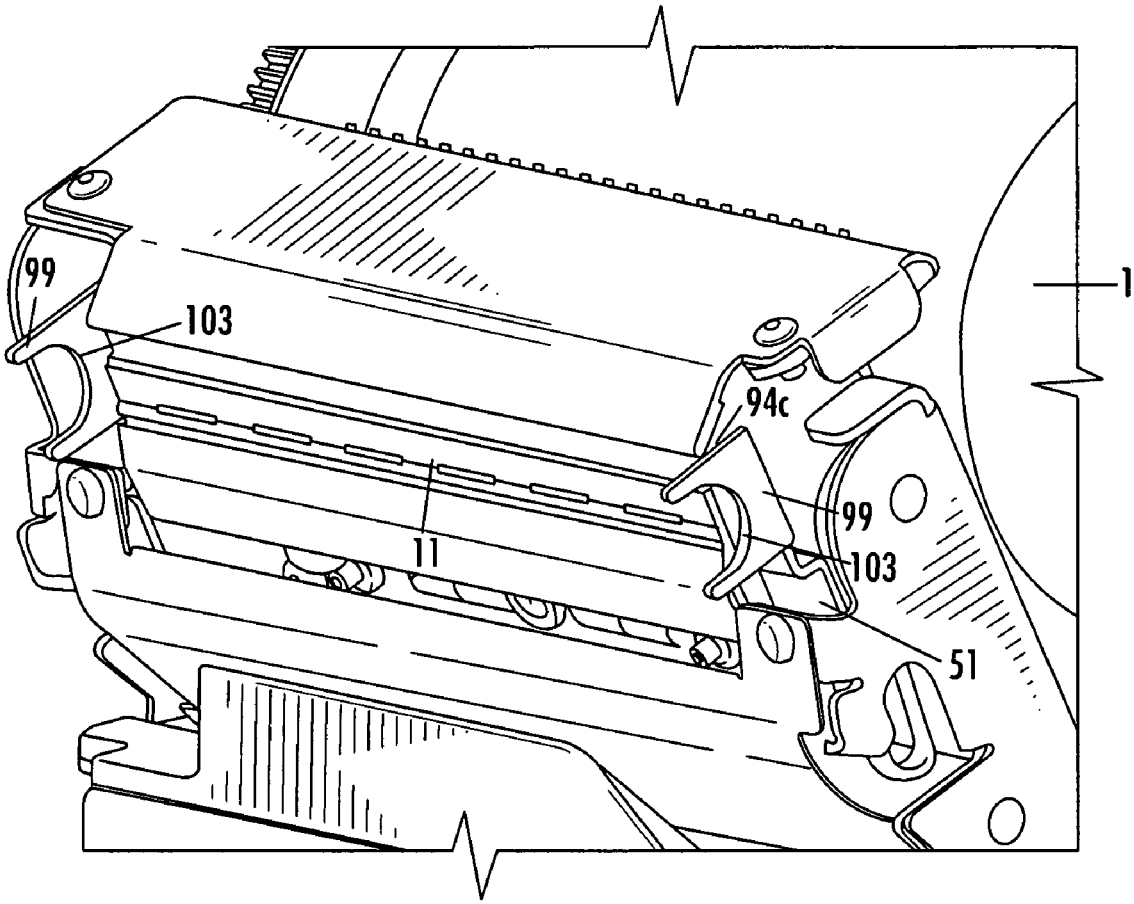
FIG. 14 is an elevated isometric view of the print head bracket of FIG. 12.
Figure 15:
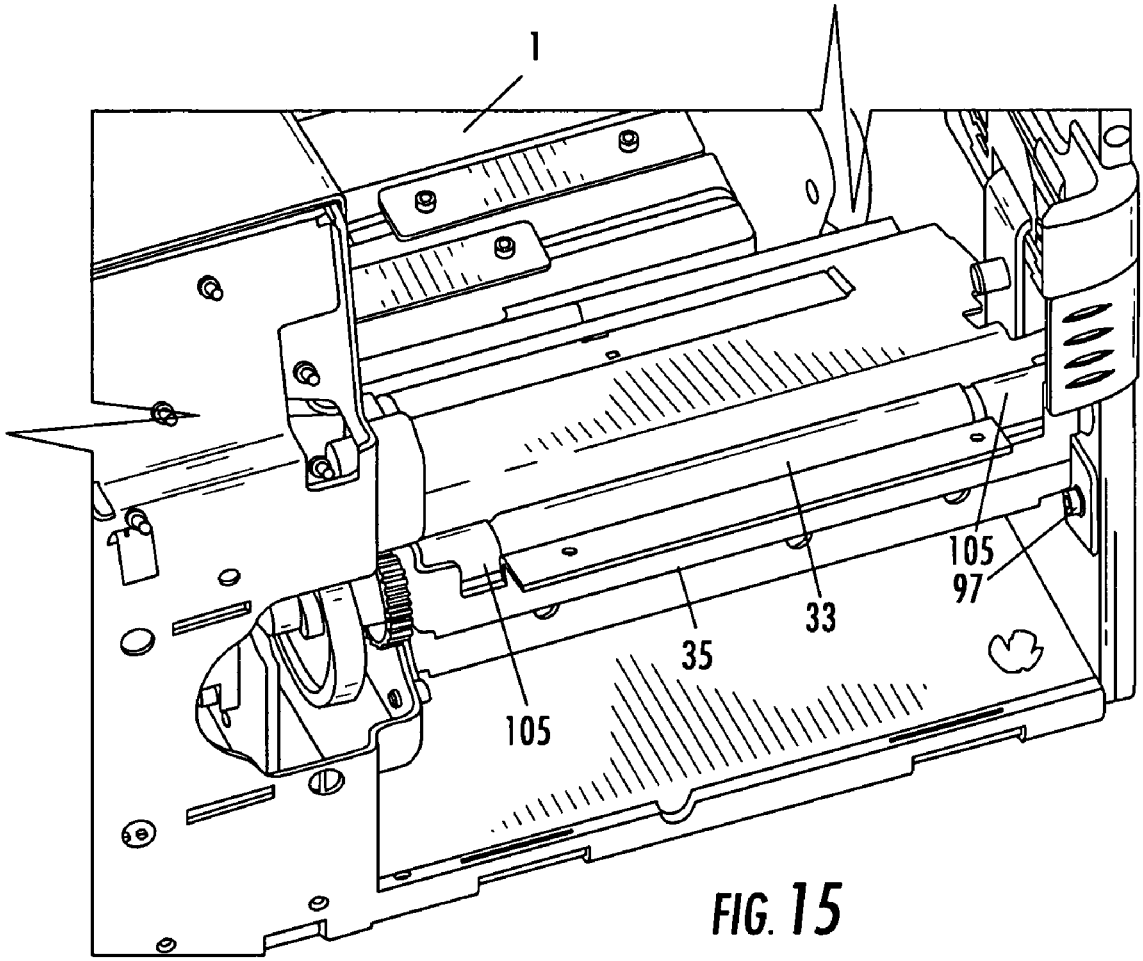
FIG. 15 is an elevated front isometric view of the platen and platen bracket located in the printer of FIG. 1 according to one embodiment of the platen bracket.
Figure 16:
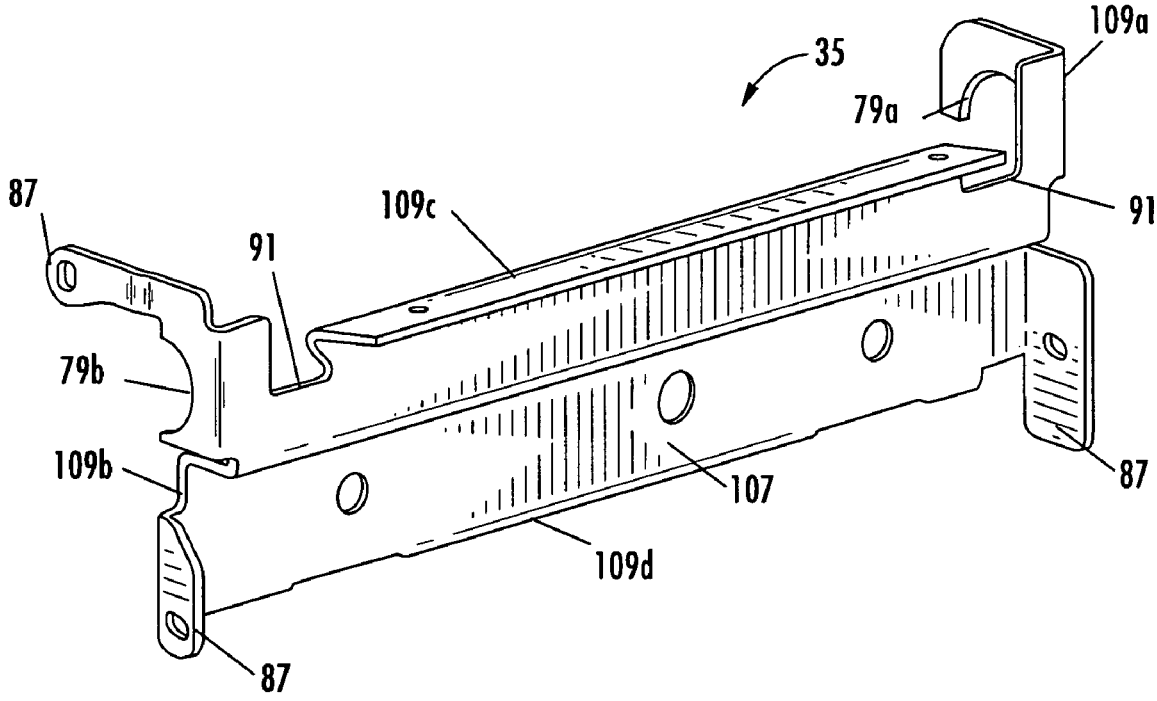
FIG. 16 is an isometric view of the platen bracket of FIG. 15.

As illustrated in FIGS. 14 and 15, the print head bracket 51 further includes one or more forks 99. The forks are typically adjacent to a front surface 94*c* of the print head bracket. The forks extend from a bottom surface of the bracket. The alignment forks include contact surfaces 103 for contacting the platen and aligning the print head with the platen. It is to be understood that the forks could be configures to contact the platen directly. However, as shown in FIG. 15, in some embodiments, the platen bracket includes bushings 105 that mate with the contact surfaces 103 of the platen bracket. As illustrated in FIGS. 15 and 16, the platen bracket 35 of this embodiment may be configured with openings 91 that allow the forks to pass therethrough and mate with the platen.

As illustrated, in operation, the print head bracket allows the print head to float relative to the bracket so as to properly align with the platen of the printer. Specifically, the retaining structures 95 retain the print head bracket 51 loosely in the printer chassis. The retaining structures allow the bracket move vertically with respect to the platen. Further, the pivot pin 59 allows the print head bracket 51 to pivot laterally, such that when the aligning forks contact the platen, the retaining structures and retaining pin allow for proper alignment with the platen both vertically and laterally.

FIGS. 15-18 illustrate an alternative embodiment to the platen bracket illustrated in FIGS. 5-9. Specifically, this bracket is designed allow the alignment forks 99 of the print head bracket illustrated in FIGS. 12-15 to mate with the platen bar via slots in the platen bracket. FIGS. 15-18 illustrate in greater detail the mating of the platen bracket with the platen. It is understood that the platen bracket of FIGS. 5-9 will have a similar mating structure between the contact surface of the bracket and the platen.

As illustrated in FIG. 15, the platen bracket 35 of this embodiment is located in front of the platen and is connected to the printer chassis by one or more fasteners 97. The platen bracket may include slots 91 for allowing access of the alignment forks 99 of the print head bracket to the platen. As illustrated in FIG. 16, the platen bracket 33 of this embodiment includes a body 107 having a width extending between opposed first and second ends, 109*a* and 109*b*, and a height extending between opposed third and fourth ends, 109*c* and 109*d*. The bracket includes connectors 87 for connecting the bracket to the printer. Further, the bracket includes one or more contact surfaces 79*a* and 79*b* located near the third end 109*c* of the bracket. The contact surfaces are generally curved so as to mate with either the platen or a bushing associated with the platen. As illustrated in the particular embodiment, one of the contact surfaces 79*a* may also be shaped to fit above the platen, while the other 79*b* engages a side of the platen.

The contact surface 79*a* of one embodiment extends from the body and comprises a curved surface, while the other contact surface 79*b* may be a curved surface formed in the body of the bracket.

Figure 17:
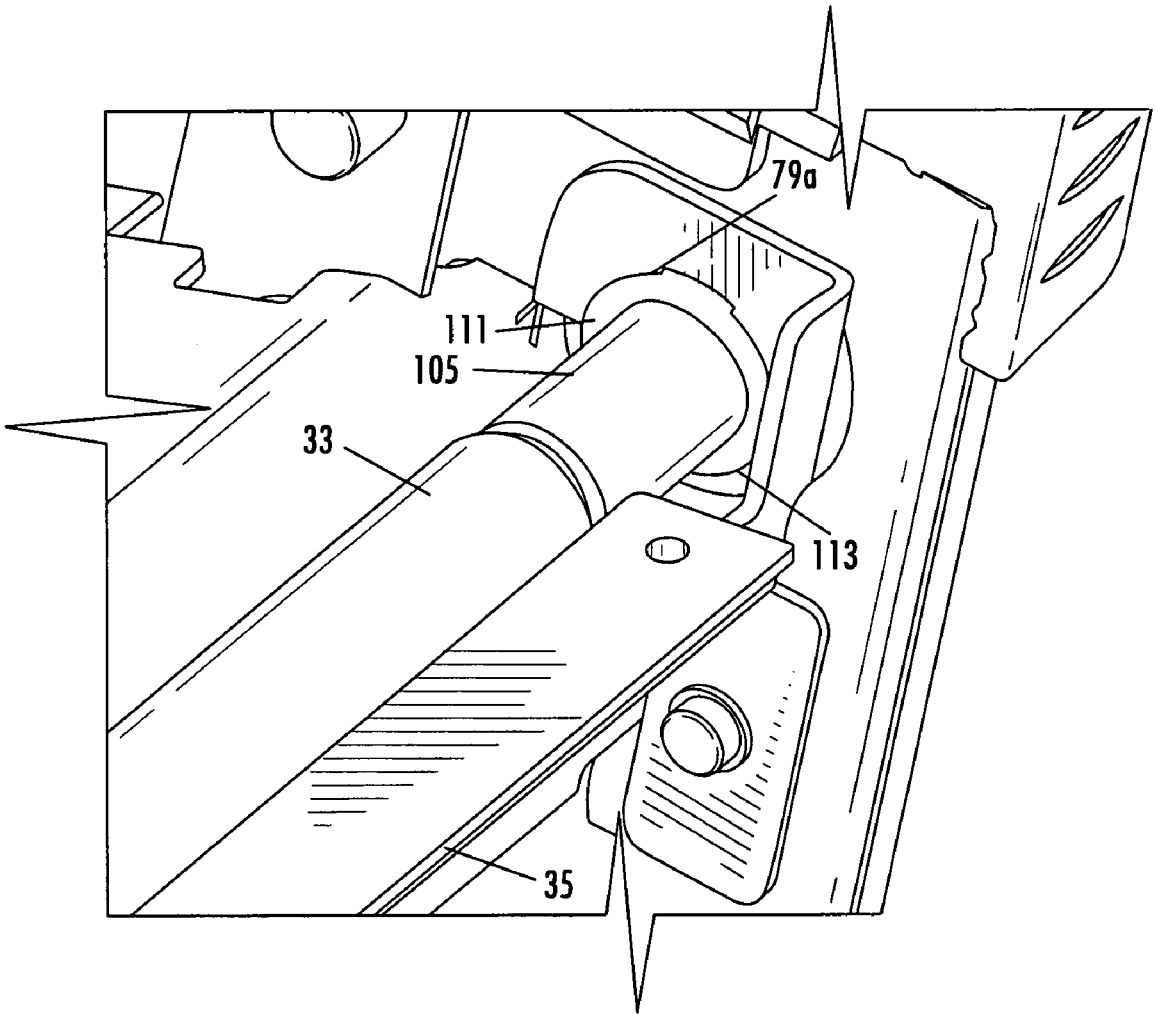
FIG. 17 is cut away isometric right side view of the platen bracket of FIG. 15 engaging the platen.
Figure 18:
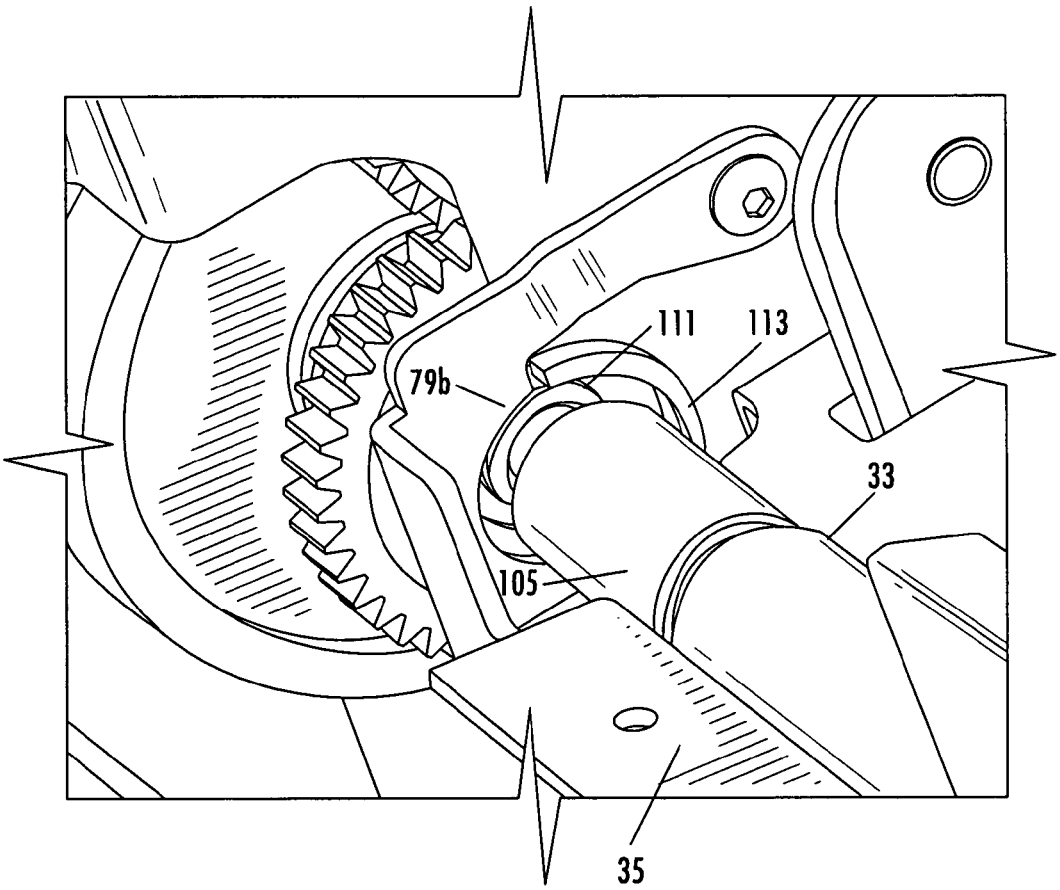
FIG. 18 is cut away isometric left side view of the platen bracket of FIG. 15 engaging the platen.

FIGS. 17 and 18 illustrate the connection between the platen bracket and the platen. Specifically, the platen may include bushings 111. The bushings are seated in a contact surface or retaining structure 113 located in the printer. The contact structure may be a hole in which the platen is inserted. The contact surfaces 79 of the platen bracket are sized to mate with the bushings 111. When installed, the contact surfaces 79 of the bracket maintain the platen in proper place. As illustrated in this embodiment, the contact surface 79*a* is shaped to fit above the platen, while the contact surface 79*b* is shaped to engage a side of the platen.

While not shown, in some embodiments, the retaining structure 113 of the printer may be a curved structure having an opening for receiving the platen. The contact surface 79*a* of the bracket could fit within the opening in the retaining structure to thereby maintain the platen in place.

The above descriptions illustrate the use of the bracket with the platen roller of the printer. It must be understood that the bracket can be used with any roller in the printer and the term platen as used herein has a broader meaning such as to refer to any roller in the printer.

Table of Parts

| | |
|---|---|
| 1 | printer |
| 3 | top door |
| 5 | front door |
| 7 | media window |
| 9 | media |
| 11 | print head |
| 13 | ribbon supply spindle |
| 15 | ribbon take-up spindle |
| 17 | frame |
| 19 | pivot point |
| 21 | media cavity |
| 23 | media guide rail(s) |
| 25 | depression(s) |
| 27 | media spindle |
| 29 | movable centering guides |
| 31 | spring lever |
| 33 | platen |
| 35 | platen bracket |
| 37 | take-up reel |
| 39 | clip |
| 41 | ramp lever |
| 43 | gear |
| 45 | tear edge |
| 47 | peel bar |
| 49 | peel surface |
| 51 | print head bracket |
| 53 | print head carrier structure |
| 55 | guide tab |
| 57 | guide slot |
| 59 | pivot pin |
| 61 | pin hole or slot |
| 63 | alignment pin |
| 65 | first alignment hole |
| 67 | second alignment hole |
| 69 | platen assembly |
| 71 | platen mounting surface |
| 73 | platen shaft |
| 75 | rotatable mounting surface |
| 77 | platen gear |
| 79 | platen contact surface |
| 81 | frame mounting screw |
| 83 | platen bracket body |
| 85 | platen bracket ends |
| 87 | platen bracket connectors |
| 89 | chassis slot |

-continued

Table of Parts

| | |
|---|---|
| 91 | platen bracket slots |
| 93 | print head bracket body |
| 94 | print head bracket ends |
| 95 | print head bracket retaining structures |
| 97 | fasteners |
| 99 | alignment forks |
| 101 | pin lip portion |
| 103 | alignment fork contact surface |
| 105 | platen bushings |
| 107 | platen bracket body |
| 109 | platen bracket body ends |
| 111 | bushing |
| 113 | retaining structure |

Where in the foregoing description reference has been made to ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as de-fined by the following claims.

The invention claimed is:

1. A system for maintaining and allowing for removal of a print head from a printer comprising:

a print head carrier structure located in the printer comprising a laterally extending carrier structure body and a pivot pin extending substantially orthogonal to the lateral extension of the carrier structure body through a bore hole in the carrier structure body of said print head carrier structure;

a bracket comprising:

a bracket body extending between opposed ends and front and rear surfaces;

at least one alignment structure adjacent to the front surface of said body for aligning the print head with a platen in the printer;

at least one retaining structure adjacent to the rear surface of the body for retaining the bracket in the printer; and at least one hole extending through said body for receiving the pivot pin of said print head carrier structure, wherein the hole and the pivot pin allow the bracket to pivot laterally.

2. A system according to claim 1 further comprising biasing means connected to the pivot pin of said print head carrier structure, wherein said biasing means biases the pivot pin into the hole of said print head carrier structure.

3. A system according to claim 2 wherein said biasing means is a spring.

4. A system according to claim 1, wherein said retaining structure of said bracket allows the bracket to move vertically with respect to a platen located in the printer.

5. A system according to claim 1, wherein the hole in said bracket is a slot defined in the body of said bracket, the slot extending from the rear surface of said body of said bracket toward the front surface of said body of said bracket.

6. A system according to claim 1, wherein the pivot pin comprises a retaining lip, wherein the hole of said bracket engages the retaining lip to thereby secure the bracket to the print head carrier structure.

7. A system according to claim 1, wherein said retaining structure of said bracket allows the bracket to move vertically with respect to a platen located in the printer and the hole of said bracket in conjunction with the pivot pin of said print head carrier structure allows the bracket to pivot laterally.

8. A system according to claim 1, wherein said alignment structure comprises a contact surface configured to contact at least one of the platen or a bushing associated with the platen.

9. A system according to claim 1, wherein said alignment structure comprises a fork having tines extending from said body of the bracket for engaging the platen.

10. A system according to claim 1, wherein said retaining structure comprises a detent that mates with a spring structure located in said print head carrier structure.

11. A system according to claim 1, wherein said retaining structure comprises a spring structure that mates with a detent located in said print head carrier structure.

12. A system according to claim 1, wherein said retaining structure comprises at least one guide slot that engages at least one guide tab associated with the chassis of the printer.

13. A system according to claim 1, wherein said alignment structure comprises a pair of alignment pins extending from said body of the bracket print head bracket that are configured to align the print head with the platen.

14. A system according to claim 13, wherein said alignment pins each define a beveled distal end.

15. A system according to claim 13 further comprising a peel bar defining first and second alignment holes that are adapted to receive the alignment pins.

16. A system according to claim 13 further comprising a tear bar defining first and second alignment holes adapted to receive the alignment pins.

* * * * *